US008596176B1

(12) United States Patent
Wagner

(10) Patent No.: US 8,596,176 B1
(45) Date of Patent: Dec. 3, 2013

(54) CUBING DEVICE

(76) Inventor: Albert J. Wagner, Commerce City, CO (US)

( * ) Notice: Subject to any disclaimer, the term of this patent is extended or adjusted under 35 U.S.C. 154(b) by 367 days.

(21) Appl. No.: 13/068,800

(22) Filed: May 19, 2011

Related U.S. Application Data

(60) Provisional application No. 61/395,891, filed on May 19, 2010.

(51) Int. Cl.
*B26D 5/22* (2006.01)
*B26D 7/06* (2006.01)

(52) U.S. Cl.
USPC ..... 83/356.3; 83/408; 99/595

(58) Field of Classification Search
USPC ..... 83/166, 404, 408, 425.1, 425.3, 425, 83/356, 356.3; 99/591–599
See application file for complete search history.

(56) References Cited

U.S. PATENT DOCUMENTS

| | | | | | |
|---|---|---|---|---|---|
| 242,660 | A * | 6/1881 | Law | 99/598 |
| 273,418 | A * | 3/1883 | Whittemore | 99/592 |
| 360,527 | A * | 4/1887 | Hudson | 99/541 |
| 1,062,429 | A * | 5/1913 | Ballod | 83/425.1 |
| 1,077,482 | A * | 11/1913 | Lippincott | 241/95 |
| 1,599,847 | A * | 9/1926 | Slee | 83/425.1 |
| 1,703,553 | A * | 2/1929 | Slaten | 83/417 |
| 2,299,092 | A * | 10/1942 | Johnson | 83/425.1 |
| 2,341,582 | A * | 2/1944 | Turner | 83/425.1 |
| 2,508,868 | A * | 5/1950 | Ross | 241/276 |
| 2,513,341 | A * | 7/1950 | Marasco | 83/679 |
| 2,661,039 | A * | 12/1953 | Davis et al. | 99/513 |
| 3,091,269 | A * | 5/1963 | Burns et al. | 83/166 |
| 3,101,833 | A * | 8/1963 | Rodrigues et al. | 198/380 |
| 3,489,357 | A * | 1/1970 | Katsuhiko | 241/95 |
| 3,516,315 | A * | 6/1970 | Hirofumi | 83/408 |
| 3,664,396 | A * | 5/1972 | Tremblay | 425/152 |
| 4,331,054 | A * | 5/1982 | Williams et al. | 83/224 |
| 4,381,687 | A * | 5/1983 | Reifenhauser | 83/404.3 |
| 4,579,028 | A * | 4/1986 | Neidhardt | 83/109 |
| 4,646,602 | A * | 3/1987 | Bleick | 83/408 |
| 4,704,959 | A * | 11/1987 | Scallen | 99/538 |
| 5,207,137 | A * | 5/1993 | Baril | 83/167 |
| 5,419,245 | A * | 5/1995 | Short | 100/125 |
| 5,784,942 | A * | 7/1998 | Jones | 83/856 |
| 5,950,528 | A * | 9/1999 | Wang | 99/542 |
| 5,983,769 | A * | 11/1999 | Schneider | 83/865 |
| 6,053,098 | A * | 4/2000 | Yamamoto | 99/538 |
| 6,516,713 | B1 * | 2/2003 | Holmander | 99/541 |

(Continued)

*Primary Examiner* — Sean Michalski
(74) *Attorney, Agent, or Firm* — Ramon L. Pizarro; Edwin H. Crabtree

(57) ABSTRACT

A device for cubing items such as fruits or vegetables is disclosed. A preferred example of the invention includes an inlet frame and an outlet frame, the inlet frame having a support plate that is supported from the inlet frame. A releasable advancement mechanism that uses a split nut is used to engage a threaded rod attached to a pressure plate. The inlet and outlet frames cooperate with a hollow elongated body to retain the pressure plate as it moves along the body in response to turning of the threaded rod. A cutting grid is supported from the outlet frame, so that movement of the pressure plate by turning the threaded rod forces a food item placed between the cutting grid and the pressure where the cutting grid cuts it as the food item is pressed against the cutting grid by the advancing pressure plate.

4 Claims, 6 Drawing Sheets

(56) References Cited

U.S. PATENT DOCUMENTS

| | | | | |
|---|---|---|---|---|
| 6,854,383 | B2 * | 2/2005 | Wang | 99/542 |
| 7,077,058 | B2 * | 7/2006 | Muro | 99/541 |
| 7,568,414 | B2 * | 8/2009 | Farid et al. | 83/435.19 |
| 7,587,968 | B1 * | 9/2009 | Roberts | 83/865 |
| 8,250,959 | B2 * | 8/2012 | Beber et al. | 83/857 |
| 2004/0261634 | A1 * | 12/2004 | Wang | 99/584 |
| 2007/0251399 | A1 * | 11/2007 | Van Heerden | 99/596 |
| 2008/0314262 | A1 * | 12/2008 | Stark | 99/595 |

* cited by examiner

CUBING DEVICE

REFERENCE TO RELATED APPLICATIONS

This application claims the benefit of my U.S. provisional application titled CUBING DEVICE, having Ser. No. 61/395,891, filed May 19, 2010, now abandoned. My Currently pending application having Ser. No. 12/802,756, filed Jun. 14, 2010, shows a cubing and peeling device.

BACKGROUND OF THE INVENTION (a) Field of the Invention

This invention generally relates to a device for cutting items into generally cubical shapes. More particularly, but not by way of limitation, to a device that cuts food items into generally cubical shapes.

(b) Discussion of Known Art

The need for a device that can make cubes, or cut generally cubical portions, of food items such as cheese, vegetables, and the like has long been known. Devices that are used to carry out this task of cutting food items into cubed sections have been developed, but suffer from the limitation that they either require a great deal of force to operate, and thus require some sort of motorized drive mechanism, or involve the inefficient use of drive shafts that transmit power from a power input crank, around the item being cut, and then to the cutting blades. These designs are adequate for manufacture from machined metal components, but do not lend themselves to production from molded polymer plastic materials. Thus known designs do not lend themselves to the efficiencies and the per-unit cost savings that can be achieved through high-volume molded polymer plastic fabrication.

The Dynamic Company of Quebec City, Quebec, Canada, distributes a food-dicing device under the trademark Dynacube, which includes a chute for accepting the food item to be processed, and a pestle that is used to push the food item into the chute while cutting blades are inside the device cut the food item in a longitudinal and transverse direction. A significant shortcoming of this type of device is that the rate of advancement of the food item through the device depends on the user's physical ability to press the food item against the longitudinal cutting blades and to advance the food item at a constant rate, in order to produce cut items of uniform shapes.

SUMMARY

It has been discovered that the problems left unanswered by known art can be solved by providing a cubing device that includes:

An inlet frame and an outlet frame, the inlet frame having a support plate that is supported from the inlet frame, the support plate supporting a split nut with internal helically-positioned surfaces that define a helical thread that creates a releasable advancement mechanism that operates by moving from a closed position where the nut sections engage the threaded rod, to an opened position where the nut sections are apart from one another, opening the helical threads;

A hollow elongated body having an outer wall, an inner wall, an inlet and an outlet, the inner wall having at least one protrusion, or discontinuity, to create an internal track, the hollow elongated body adapted for accepting a cutting grid attached to the outlet, the cutting grid engaging the protrusion, and the inlet of the hollow elongated body being adapted for engagement with the support plate that is supported from the support frame;

A threaded rod having a first end and a second end, the first end being attached to a pressure plate that includes a recess or the like that cooperates with the protrusion on the hollow elongated body to index movement of the pressure plate to the movement of the hollow elongated body, and the second end being adapted for attachment to a crank for turning the threaded rod, the threaded rod extending through the split nut, so that when the split nut is in the first position the internal threads of the split nut engage the threaded rod, so that the turning of the crank rotates the threaded rod relative to the split nut, causing the threaded rod to advance relative to the split nut, causing the pressure plate to move towards the cutting grid, and so that moving the split nut to the open position allows threaded rod to be moved back, away from the cutting grid, and so that as the pressure plate advances towards the cutting grid, it forces a food item placed between the cutting grid and the pressure plated to be cut by the cutting grid as the food item is pressed against the cutting grid.

It is further contemplated that the disclosed invention will be used with a slicing blade that is positioned next to the cutting grid, so that food that has been cut by the cutting grid is then cut the slicing blade as it moves past the cutting grid. It will be understood by those skilled in the art that the connection of the pressure plate and the cutting grid to the hollow elongated body will allow these components to rotate in concert, and thus causing the food item to be cut longitudinally when the pressure plate advances due to the rotation of the crank while the split nut engages the threaded rod.

According to a preferred embodiment of the invention, an external housing that extends between the inlet frame and the outlet frame. Additionally, it is also contemplated that a collection tray may be attached to the outlet frame.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
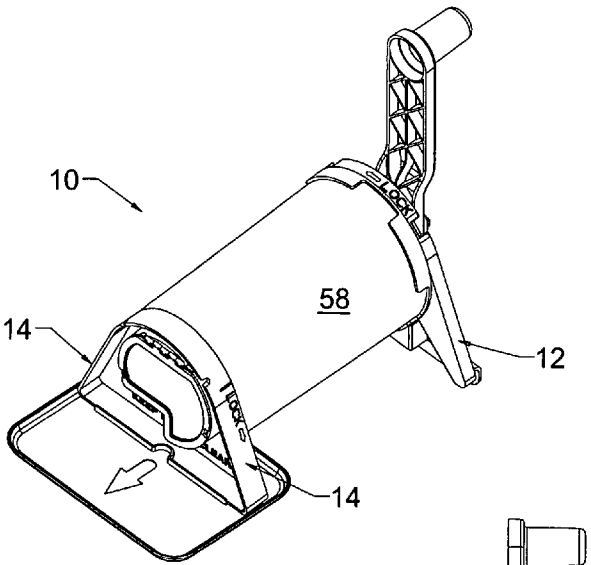
FIG. 1 is a perspective view of a highly preferred embodiment of the invention.
Figure 5:
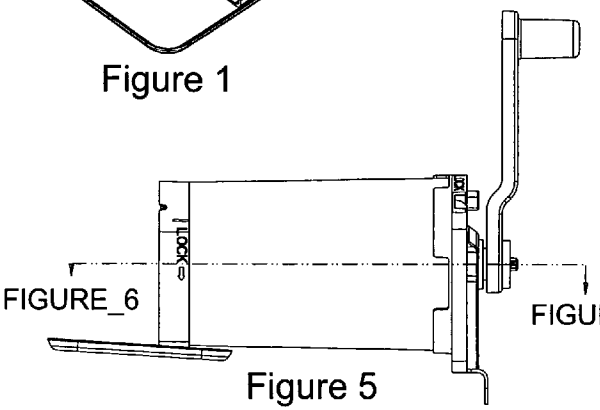
FIG. 5 is a side view of the embodiment illustrated in FIG. 1.
Figure 3:
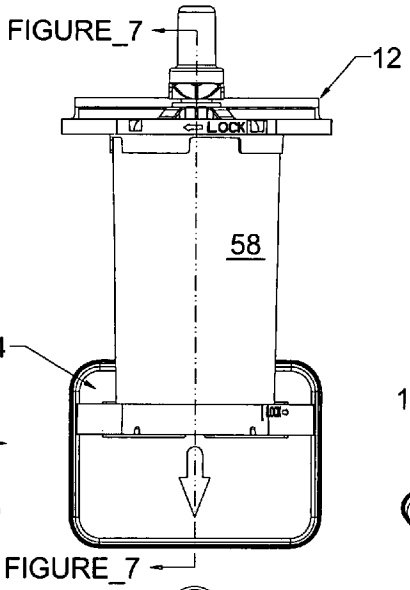
FIG. 3 is a view looking down at the embodiment illustrated in FIG. 1.
Figure 4:
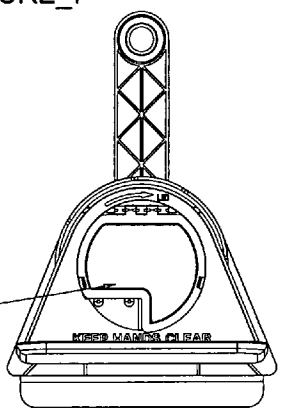
FIG. 4 is a view looking from the outlet frame towards the inlet frame, at the embodiment illustrated in FIG. 1.
Figure 2:
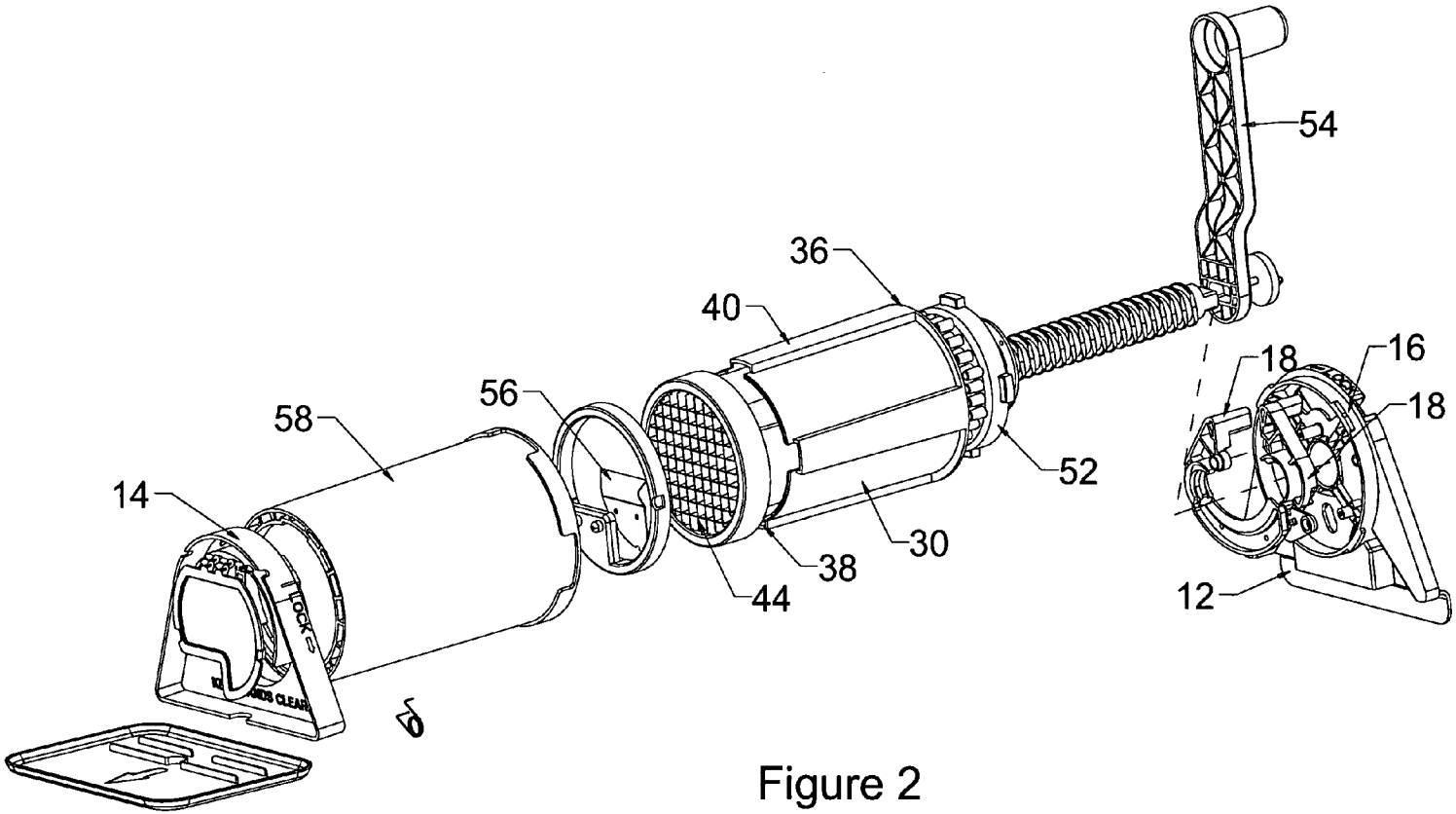
FIG. 2 is an exploded view of the embodiment illustrated in FIG. 1.
Figure 6:
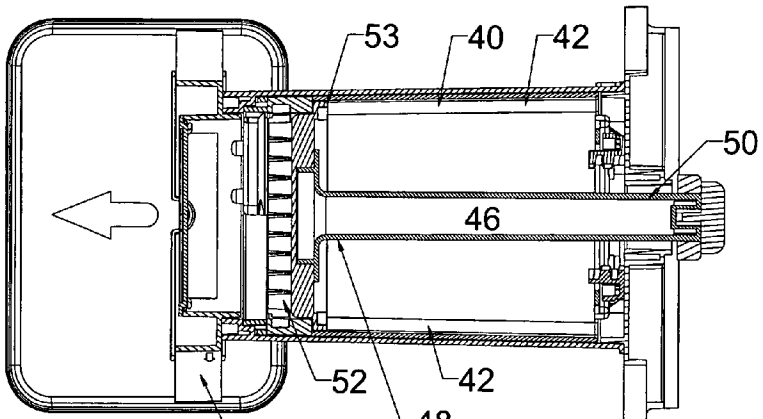
FIG. 6 is a view looking down along a section taken as indicted by the arrows 6-6 from FIG. 5 at the embodiment illustrated in FIG. 1.
Figure 7:
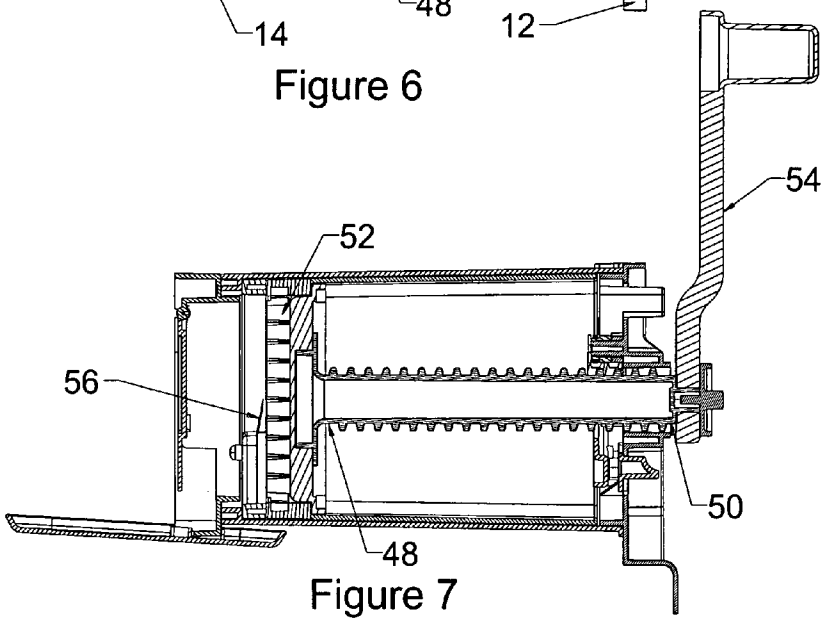
FIG. 7 is a view looking down along a section taken as indicted by the arrows 7-7 from FIG. 3 at the embodiment illustrated in FIG. 1.
Figure 8:
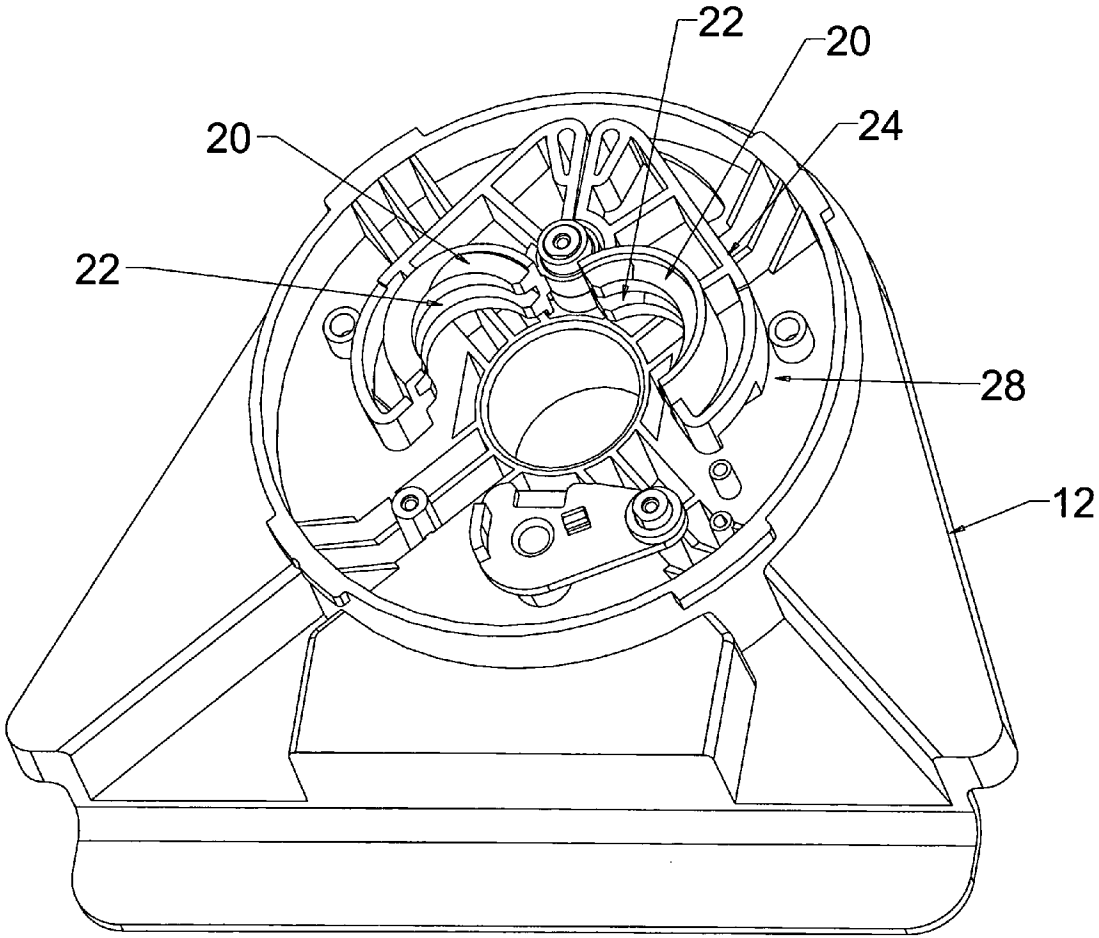
FIG. 8 is a detailed view of the inlet frame, showing the split nut in the second, opened, position.
Figure 9:
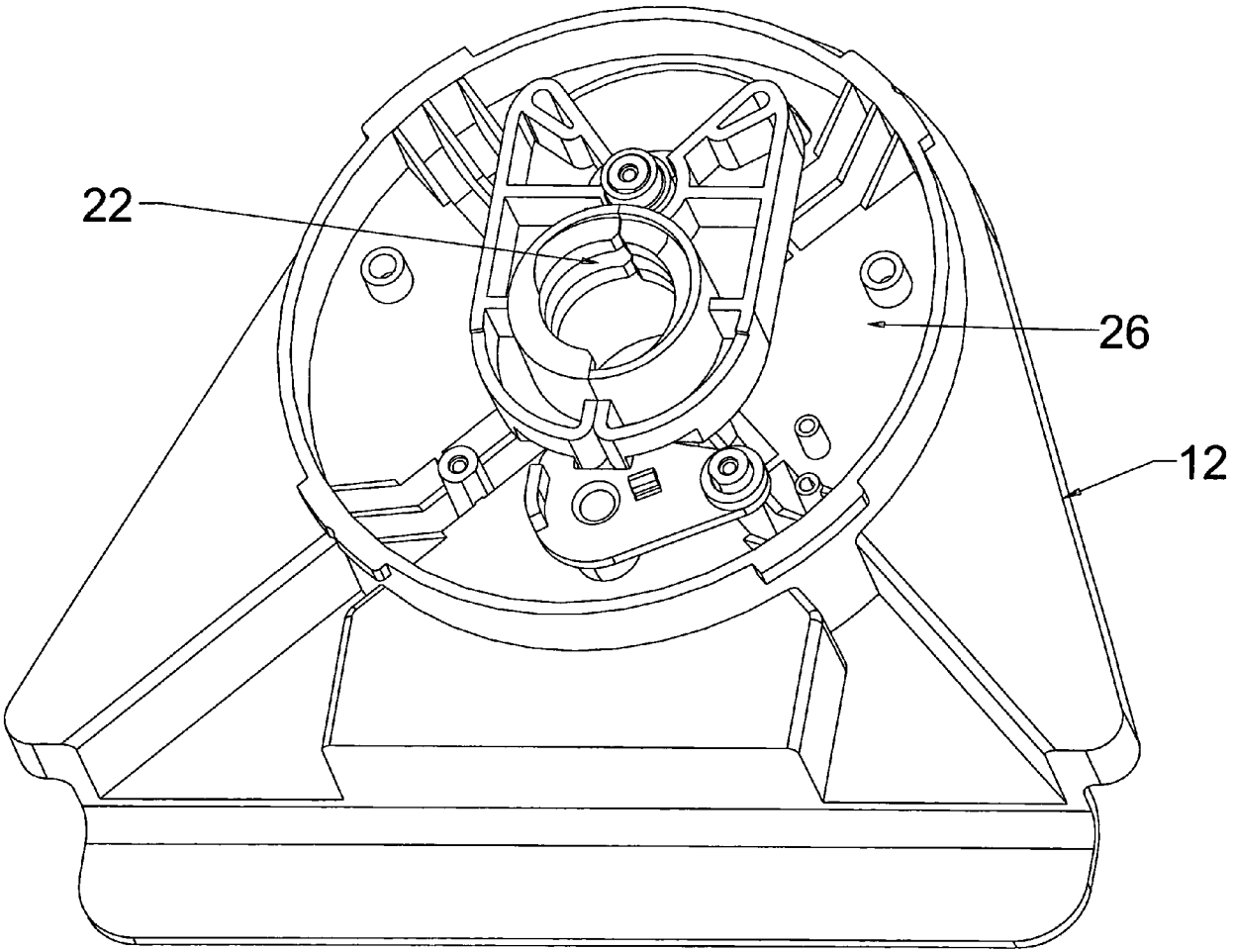
FIG. 9 is a detailed view of the inlet frame, showing the split nut in the first, closed, position.
Figure 10:
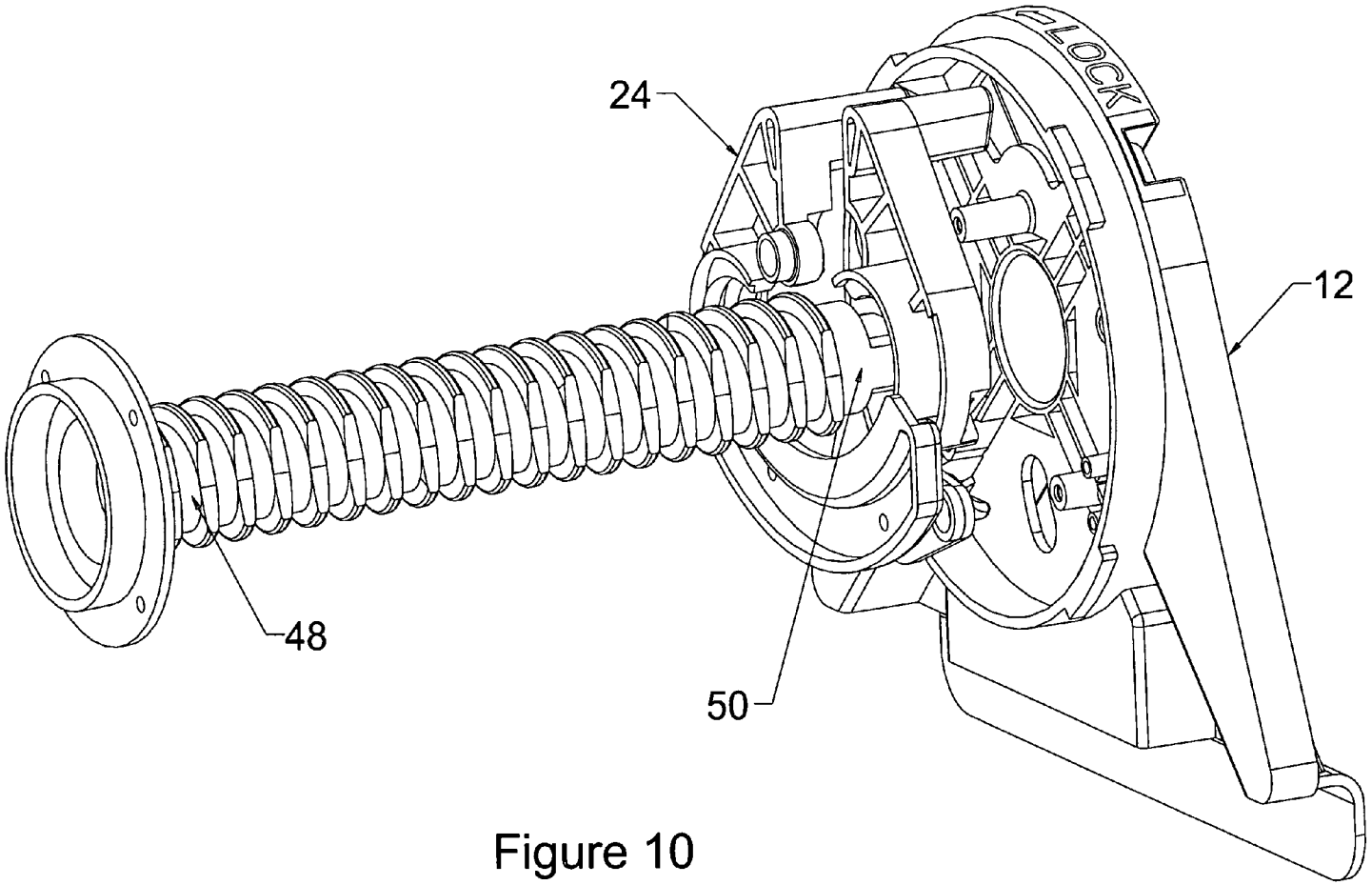
FIG. 10 is an exploded view, illustrating the cooperation of the threaded rod, the split nut, and the inlet frame, the threaded rod being shown with the pressure plate removed.

Turning now to FIG. 1 where a cubing device 10 for cutting food items into six-sided pieces has been illustrated showing preferred embodiments of the disclosed invention. The example of the cubing device has been shown having inlet frame 12 and an outlet frame 14. The inlet frame 12 has been illustrated having a support plate 16 that is supported from, or is of integral, one-piece construction, with the inlet frame. The support plate 16 is used to support a split nut 18 that includes or defines internal helically-positioned surfaces 20 that define a helical thread 22. The split nut 18 creates a releasable advancement mechanism 24 that operates by moving a pair of nut sections 19 from a closed position 26 where the nut sections engage a threaded rod 46 that is used advance the food item being cubed. The threaded rod 46 will include threads that are adapted to cooperate with the helical surfaces 20 of the split nut 18. To return the advancement mechanism 24 its original position, the split nut 18 may be moved to an opened position 28 where the nut sections 19 are apart from one another, opening the helical threads 22 and allowing movement of threaded rod 46 relative to the split nut 18 without engagement of the helical surfaces. It will be apparent to those skilled in the art that the disclosed inventive aspects disclosed herein may be practiced without the use of the split nut 18. However, such an approach is likely to require that the user reverse the rotation of the threaded rod 46 to return the threaded rod to the starting position.

The threaded rod 46 will travel within a hollow elongated body 30 that includes an outer wall 32, an inner wall 34, an inlet 36, and an outlet 38. The inner wall 34 will preferably include at least one protrusion, or discontinuity 40, to create an internal track. The hollow elongated body 30 will preferably be adapted for accepting a cutting grid 44 that is attached to the outlet 38. Most preferably, the cutting grid 44 will engage the protrusion or discontinuity 40, but may also be held in a fixed relation to the outlet 38 by other known devices, such as fasteners. Also, according to the preferred embodiment of the invention the inlet 36 of the hollow elongated body 30 is adapted for engagement with the inlet frame 12 or the support plate 16.

The enclosed FIGS. 1-10 also show that the threaded rod 46 includes a first end 48 and a second end 50. The first end 48 is attached to a pressure plate 52 that includes a recess 53 or the like that cooperates with the protrusion or discontinuity 40 on the hollow elongated body 30. The mating of the recess 53 and the protrusion or discontinuity 40 serves to index or fix the rotational movement of the pressure plate 52 to the movement of the hollow elongated body 30. The second end 50 of the threaded rod 46 is adapted for attachment to a crank 54 or other power input device.

The crank 54 is used for turning the threaded rod 46 when the helical thread 22 of the split nut 18 engages the threaded rod 46, when the split nut 18 is in the first position. The turning of the crank 54 will cause the threaded rod 46 to advance relative to the split nut 18, while at the same time causing the pressure plate 52 to advance towards the cutting grid 44, so that as the pressure plate 52 advances towards the cutting grid 44, the pressure plate 52 forces a food item placed between the cutting grid 44 and the pressure plate 52 to be cut by the cutting grid 44 as the food item is pressed against the cutting grid 44. Moving the split nut 18 to the open position allows threaded rod 46 to be moved back, away from the cutting grid 44, and thus allowing the user to insert another food item into the device.

It is also important to note that it is contemplated that a slicing blade 56 will be positioned next to the cutting grid 44, so that food that has been cut by the cutting grid is then cut the slicing blade as it moves past the cutting grid. The slicing blade 56 may be mounted from the outlet frame 14. Still further, it is contemplated that a tray 58 may also be attached to the outlet frame, to collect food items that have been cut with the disclosed invention.

Still further, it will be understood that the disclosed invention uses the connection of the pressure plate 52 and the cutting grid 44 to the hollow elongated body 30 will allow these components to rotate in concert, and thus causing the food item to be cut longitudinally when the pressure plate advances due to the rotation of the crank while the split nut 18 engages the threaded rod 46. The enclosed figures also show that it is contemplated that an external housing 60 that extends between the inlet frame 12 and the outlet frame 14 may be used to retain the relationship between the inlet frame 12 and the outlet frame 14.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A cubing device for cutting food items into six-sided pieces, the device comprising:

an inlet frame and an outlet frame, the inlet frame having a support plate supported from the inlet frame, the support plate supporting a split nut with internal helically-positioned surfaces that define a helical thread that creates a releasable advancement mechanism that operates by moving from a closed position where the nut sections engage the threaded rod, to an opened position where the nut sections are apart from one another, opening the helical threads;

a hollow elongated body having an outer wall, an inner wall, an inlet and an outlet, the inner wall having at least one protrusion, or discontinuity, to create an internal track, the hollow elongated body adapted for accepting a cutting grid attached to the outlet, the cutting grid engaging the protrusion, and the inlet of the hollow elongated body being adapted for engagement with the support plate that is supported from the support frame;

a threaded rod having a first end and a second end, the first end being attached to a pressure plate that includes a recess or the like that cooperates with the protrusion on the hollow elongated body to index movement of the pressure plate to the movement of the hollow elongated body, and the second end being adapted for attachment to a crank for turning the threaded rod, the threaded rod extending through the split nut, so that when the split nut is in the first position the internal threads of the split nut engage the threaded rod, so that the turning of the crank rotates the threaded rod relative to the split nut, causing the threaded rod to advance relative to the split nut, causing the pressure plate to move towards the cutting grid, and so that moving the split nut to the open position allows threaded rod to be drawn back, away from the cutting grid, and so that as the pressure plate advances towards the cutting grid, it forces a food item placed between the cutting grid and the pressure plated to be cut by the cutting grid as the food item is pressed against the cutting grid.

2. A device according to claim 1 and further comprising a slicing blade that is positioned next to the cutting grid, so that food that has been cut by the cutting grid is then cut the slicing blade as it moves past the cutting grid.

3. A device according to claim 1 wherein the connection of the pressure plate and the cutting grid to the hollow elongated body will allow these components to rotate in concert, and thus causing the food item to be cut longitudinally when the pressure plate advances due to the rotation of the crank while the split nut engages the threaded rod.

4. A device according to claim 1 and further comprising an external housing that extends between the inlet frame and the outlet frame.

* * * * *